US008819975B2

(12) United States Patent
Herring

(10) Patent No.: US 8,819,975 B2
(45) Date of Patent: Sep. 2, 2014

(54) RIFLE AND KIT FOR MAKING SAME

(75) Inventor: Geoffrey A. Herring, West Melbourne, FL (US)

(73) Assignee: Ares Defense Systems, Inc., Melbourne, FL (US)

( * ) Notice: Subject to any disclaimer, the term of this patent is extended or adjusted under 35 U.S.C. 154(b) by 495 days.

(21) Appl. No.: 12/655,957

(22) Filed: Jan. 11, 2010

(65) Prior Publication Data

US 2010/0186276 A1 Jul. 29, 2010

Related U.S. Application Data

(60) Provisional application No. 61/205,975, filed on Jan. 26, 2009.

(51) Int. Cl.

| | |
|---|---|
| ***F41C 7/00*** | (2006.01) |
| ***F41A 11/02*** | (2006.01) |
| ***F41C 23/00*** | (2006.01) |

(52) U.S. Cl.

USPC ..... 42/6; 42/72; 42/75.02; 42/75.03

(58) Field of Classification Search

USPC ..... 42/6, 71.01, 72, 77, 75.01, 75.02, 42/75.03; 89/128

See application file for complete search history.

(56) References Cited

U.S. PATENT DOCUMENTS

| | | | | |
|---|---|---|---|---|
| 1,367,996 | A * | 2/1921 | Sussman | 42/72 |
| 2,324,125 | A * | 7/1943 | Van Horn et al. | 89/141 |
| 2,585,275 | A | 2/1952 | Ruger | |
| 2,624,969 | A | 1/1953 | Ruger | |
| 2,655,839 | A | 10/1953 | Ruger | |
| 3,267,923 | A * | 8/1966 | Ronci | 124/84 |
| 3,641,694 | A * | 2/1972 | Seidel et al. | 42/72 |
| 3,685,194 | A * | 8/1972 | Coon | 42/77 |
| 5,351,428 | A * | 10/1994 | Graham | 42/72 |
| 5,448,940 | A * | 9/1995 | Schuetz et al. | 89/185 |
| 5,924,233 | A * | 7/1999 | Strobel | 42/72 |
| 6,318,014 | B1 * | 11/2001 | Porter | 42/72 |
| 6,513,274 | B1 * | 2/2003 | Vastag | 42/77 |
| 6,634,128 | B1 * | 10/2003 | Vastag | 42/59 |
| 2006/0101695 | A1 * | 5/2006 | Longueira | 42/69.02 |
| 2007/0006508 | A1 * | 1/2007 | Baker et al. | 42/71.02 |
| 2011/0005383 | A1 * | 1/2011 | Kramer | 89/191.01 |
| 2012/0137872 | A1 * | 6/2012 | Crommett | 89/193 |

* cited by examiner

*Primary Examiner* — Bret Hayes

(57) ABSTRACT

A rifle kit comprises a rifle receiver structure having a central passage configured for having a substantially as-manufactured breech bolt of a pistol mounted therein and has one or more shoulder stock mounting portions configured for having a shoulder stock structure engaged therewith. A substantially as-manufactured breech bolt of the kit is configured by an original equipment manufacturer (OEM) thereof for being mounted on a pistol receiver body configured by the OEM. The rifle barrel is mountable within the central passage of the rifle receiver structure. A chamber end portion of the rifle barrel is configured for engaging a mating portion of the substantially as-manufactured breech bolt. A shoulder stock structure of the kit includes a receiver structure engaging portion configured for allowing the shoulder stock structure to be mounted on the rifle receiver structure exclusively through engagement with the one or more stock mounting portions of the rifle receiver structure.

11 Claims, 3 Drawing Sheets

RIFLE AND KIT FOR MAKING SAME

CROSS REFERENCE TO RELATED APPLICATIONS

This patent application claims priority from co-pending U.S. Provisional Patent Application having Ser. No. 61/205,975, filed Jan. 26, 2009, entitled "Rifle And Kit For Producing Same", having a common applicant herewith and being incorporated herein in its entirety by reference.

FIELD OF THE DISCLOSURE

The disclosures made herein relate generally to firearms and, more particularly, to interchangeability and interoperability between components of rifles and pistols.

BACKGROUND

Pistols are generally compact and lightweight relative to a rifle that uses a similar size round of ammunition (i.e., a comparable rifle). However, the shorter barrel of a pistol and their lack of a shoulder stock make them less accurate when compared to a comparable rifle because it typically employs a longer barrel and/or shoulder stock. Furthermore, the longer barrel also provides for improved ballistic performance due to a resulting velocity increase of the projectile.

Many firearms that are commonly used for basic firearms training and sporting purposes such as target practice and small game hunting are designed by their manufacturers to chamber and fire a readily available and economical cartridge. The 22-caliber LR (i.e., .22LR) cartridge is a prime example of such a readily available and economical cartridge. Due in large part to it being a readily available and economical cartridge, the .22LR cartridge is also a favorite cartridge for hunting small game such as rabbits and squirrels and is, therefore, an excellent choice when an individual is contemplating a survival rifle for backpacking, canoeing, aviation, etc. Most .22LR firearms are relatively lightweight due to the low power of the .22LR cartridge, which further makes them appealing both for firing at an indoor range and for those learning to safely handle and shoot a firearm.

Firearms chambered for a .22LR cartridge are readily available in both rifle and pistol configurations. Examples of rifles chambered for a .22LR cartridge (i.e., a .22LR rifle) include, but are not limited to, the Marlin brand "Papoose", the Ruger brand "10/22", and the Remington brand "Mod. 50". Examples of pistols chambered for a .22LR cartridge (i.e., a .22LR pistol) include, but are not limited to, the Browning brand "Buckmark", the High Standard brand "Plinker", the Colt brand "Woodsman" and the Ruger brand "Mk-II". Of the .22LR rifles commercially available, the Ruger brand "10/22" is one of the most popular rifles with recreational shooters and the Ruger brand "Mk-II" is one of the most popular .22LR pistols.

Known .22LR rifles have the drawback of being considerably heavier and longer than comparable .22LR pistols. Furthermore, part interchangeability and operational characteristics between known .22LR rifles and .22LR pistols is effectively non-existent. Still further, while an individual can practice and gain proficiency shooting on the range with an economically priced .22LR pistol, the operational characteristics will generally be completely different when transitioning from a .22LR pistol to a .22LR rifle. Therefore, what is needed is a rifle (e.g., a .22LR rifle) that shares ergonomics, operational characteristics, and components with a comparably chambered pistol (e.g., a .22LR pistol) and a kit that permits an individual to utilize components from a pistol (e.g., .22LR pistol) in carrying out assembly of a similarly chambered rifle (e.g., .22LR rifle).

SUMMARY OF THE DISCLOSURE

Embodiments of the present invention relate to a rifle that shares ergonomics, operational characteristics, and components with a comparably chambered pistol. In a preferred embodiment, the present invention is configured as a kit that permits an individual to utilize components from a pistol of a given in the assembly of a similarly chambered rifle. A .22LR rifle is an example of such a rifle and a .22LR pistol is an example of such a pistol.

In one embodiment of the present invention, a method for producing a rifle from components of a pistol comprises a plurality of operations. An operation is performed for providing a substantially as-manufactured trigger group housing configured by an original equipment manufacturer (OEM) thereof for having a corresponding pistol receiver body of the pistol mounted thereon. The substantially as-manufactured trigger group housing is configured for having an ammunition magazine mounted therein and for allowing ammunition to be supplied therethrough from the ammunition magazine to the pistol receiver body. An operation is performed for providing a substantially as-manufactured breech bolt that is configured by its OEM for being mounted on the pistol receiver body and for detachably mounting a rifle receiver structure on the substantially as-manufactured trigger group housing. The rifle receiver structure is configured for having the substantially as-manufactured breech bolt mounted thereon, for having magazine-fed ammunition supplied thereto through the substantially as-manufactured trigger group housing, and for having a shoulder stock structure mounted thereon. An operation is performed for mounting the substantially as-manufactured breech bolt on the rifle receiver structure. An operation is performed for mounting the shoulder stock structure entirely on the rifle receiver structure or for attaching the shoulder stock structure to the substantially as-manufactured trigger group housing through the rifle receiver structure.

In another embodiment of the present invention, a kit for producing a rifle from components of a pistol comprises a rifle receiver structure, a rifle barrel, and a shoulder stock structure. The rifle receiver structure has a central passage configured for having a substantially as-manufactured breech bolt of a pistol mounted therein and has one or more shoulder stock mounting portion configured for having the shoulder stock structure engaged therewith. The substantially as-manufactured breech bolt is configured by an original equipment manufacturer (OEM) thereof for being mounted on a pistol receiver body configured by the OEM. The rifle barrel is mountable within the central passage of the rifle receiver structure. A chamber end portion of the rifle barrel is configured for engaging a mating portion of the substantially as-manufactured breech bolt. The shoulder stock structure includes a receiver structure engaging portion configured for allowing the shoulder stock structure to be mounted on the rifle receiver structure exclusively through engagement with the one or more shoulder stock mounting portions of the rifle receiver structure.

In another embodiment of the present invention, a rifle comprises a substantially as-manufactured breech bolt, a rifle receiver structure, a rifle barrel, a substantially as-manufactured trigger group housing, and a shoulder stock structure. The substantially as-manufactured breech bolt is that of a Ruger brand MK-series pistol. The substantially as-manufactured breech bolt is configured by an original equipment manufacturer (OEM) thereof for being mounted on a Ruger brand MK-series pistol receiver body configured by the OEM. The rifle receiver structure has the substantially as-manufactured breech bolt slideably mounted within a central passage thereof. The rifle barrel is mounted within the central passage of the rifle receiver structure. A chamber end portion of the rifle barrel has a mating end portion of the substantially as-manufactured breech bolt selectively engagable therewith. The substantially as-manufactured trigger group housing is that of a Ruger brand MK-series pistol and is mounted on the rifle receiver structure. A receiver engaging portion of the substantially as-manufactured trigger group housing is configured by an OEM thereof for having a trigger group housing engaging portion of a corresponding pistol receiver body thereof engaged therewith. The substantially as-manufactured trigger group housing is configured for having an ammunition magazine mounted therein and for allowing ammunition to be supplied therethrough from the ammunition magazine mounted thereon to the pistol receiver body. The shoulder stock structure is mounted entirely on the rifle receiver structure or is attached to the substantially as-manufactured trigger group housing through the rifle receiver structure.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
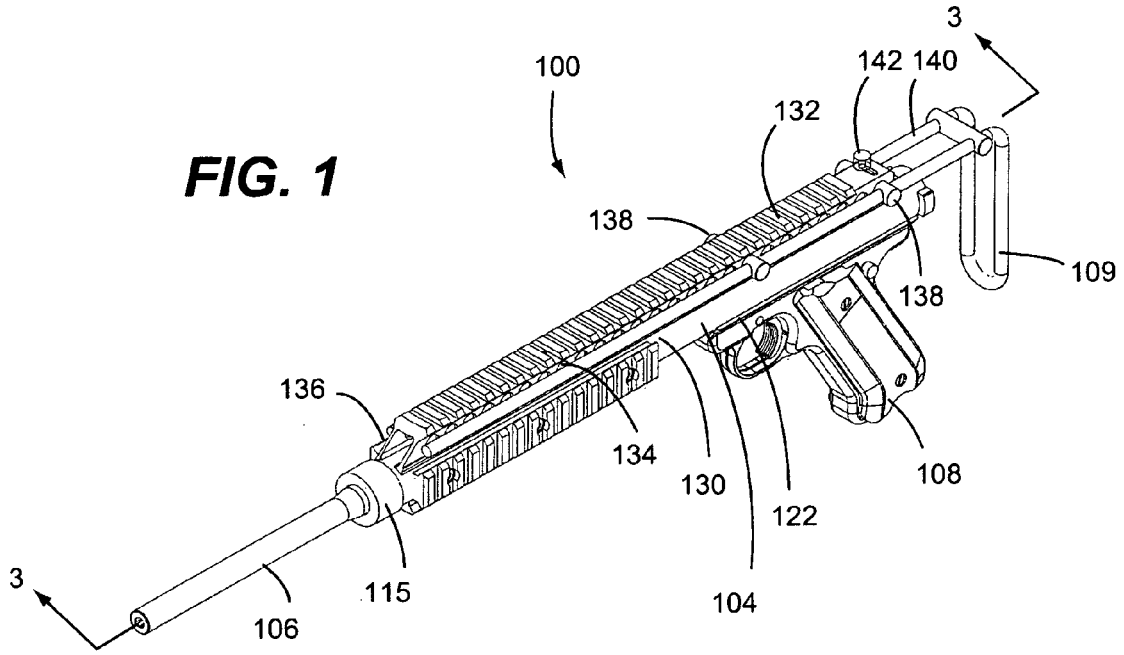
FIG. 1 is a first perspective view of a rifle configured in accordance with an embodiment of the present invention.
Figure 2:
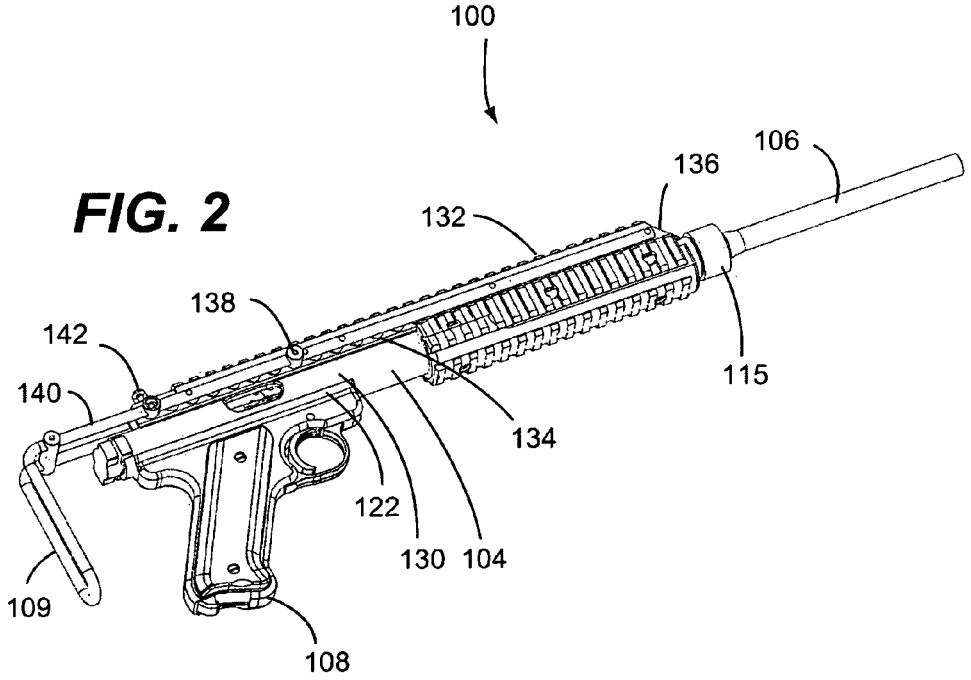
FIG. 2 is a second perspective view of the rifle shown in FIG. 1.
Figure 3:
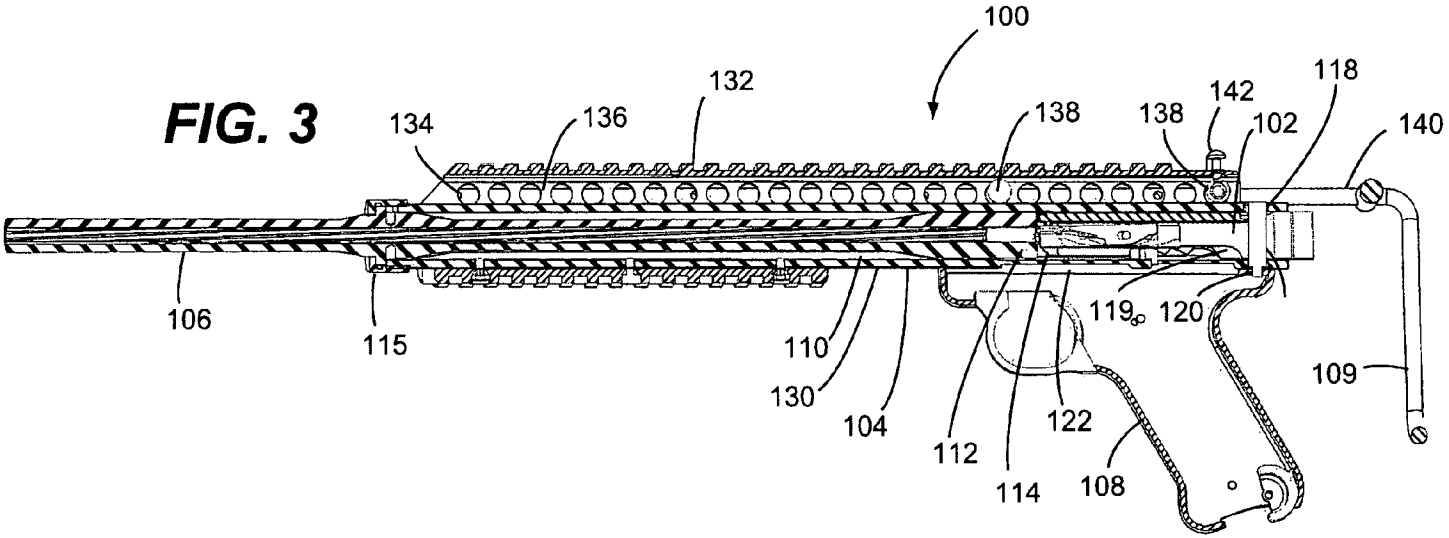
FIG. 3 is a cross-sectional view taken along the line 3-3 in FIG. 1.

FIGS. 1-3 shown a rifle 100 (i.e., a firearm) configured in accordance with an embodiment of the present invention. Advantageously, the rifle 100 shares ergonomics, operational characteristics, and components with a comparably chambered pistol. In a preferred embodiment, the rifle 100 has been produced using a kit configured for allowing components from such a comparably chambered pistol in carrying out assembly of a similarly chambered rifle. A .22LR rifle is an example of the rifle 100 and a .22LR pistol is an example of the comparably chambered pistol. A Ruger brand MK-series piston is a specific example of the comparably chambered pistol.

The rifle 100 comprises a substantially as-manufactured breech bolt 102, a rifle receiver structure 104, a rifle barrel 106, a substantially as-manufactured trigger group housing 108, and a shoulder stock structure 109. The substantially as-manufactured breech bolt 102 is configured by an original equipment manufacturer (OEM) thereof for being mounted on a pistol receiver body that is configured by its OEM for being operable with the substantially as-manufactured breech bolt 102 and the substantially as-manufactured trigger group housing 108. The substantially as-manufactured breech bolt 102 and the substantially as-manufactured trigger group housing 108 can be that of a Ruger brand MK-series pistol. It is disclosed herein that the term substantially as-manufactured can refer to a component being unmodified from a configuration as provided by an original manufacturer (or designer) of the component (i.e., OEM).

The rifle receiver structure 104 has the substantially as-manufactured breech bolt 102 slideably mounted within a central passage 110 thereof. The rifle barrel 106 is mounted within the central passage 110. A chamber end portion 112 of the rifle barrel 106 has a mating end portion 114 of the substantially as-manufactured breech bolt 102 selectively engagable therewith. A retaining collar 115 is jointly engaged with the rifle receiver structure 104 and the rifle barrel 106 for fixedly securing the rifle barrel 106 within the central passage 110. It is disclosed herein that the rifle barrel 106 can be attached to the rifle receiver structure by any one of several known means (e.g., welding, threaded engagement, pinned retention, and the like).

The substantially as-manufactured trigger group housing 108 is mounted on the rifle receiver structure 104 and is secured thereto by a breech bolt securing device 116. The breech bolt securing device 116 extends through a passage 118 in the rifle receiver structure 104, through a slot 119 in the substantially as-manufactured breech bolt 102, and into engagement with the substantially as-manufactured trigger group housing 108 within a passage 120 thereof. A receiver engaging portion 122 of the substantially as-manufactured trigger group housing 108 is configured by an OEM thereof for having a trigger group housing engaging portion of a corresponding pistol receiver body thereof engaged therewith. The substantially as-manufactured trigger group housing 108 is configured for having an ammunition magazine mounted therein and for allowing ammunition to be supplied therethrough to the pistol receiver body from the ammunition magazine mounted thereon.

In one embodiment, the breech bolt securing device 116 can be a fastener such as a bolt or a pin. In a specific embodiment, the breech bolt securing device 116 is a component of a trigger group housing securing assembly that is integral with the substantially as-manufactured trigger group housing 108. For example, in the case where the substantially as-manufactured breech bolt 102 and the substantially as-manufactured trigger group housing 108 are that of a Ruger brand MK-series pistol, such a trigger group housing securing assembly can be configured in the same manner or similar manner to that disclosed in U.S. Pat. No. 2,585,275 of Ruger (e.g., including components 35, 44, 45, 52 and 55).

Figure 4:
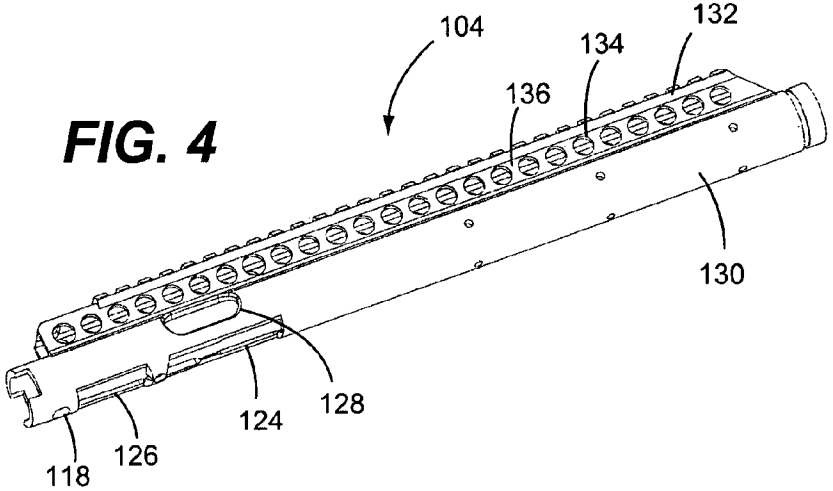
FIG. 4 is a perspective view of a rifle receiver structure of the rifle shown in FIG. 1.
Figure 6:
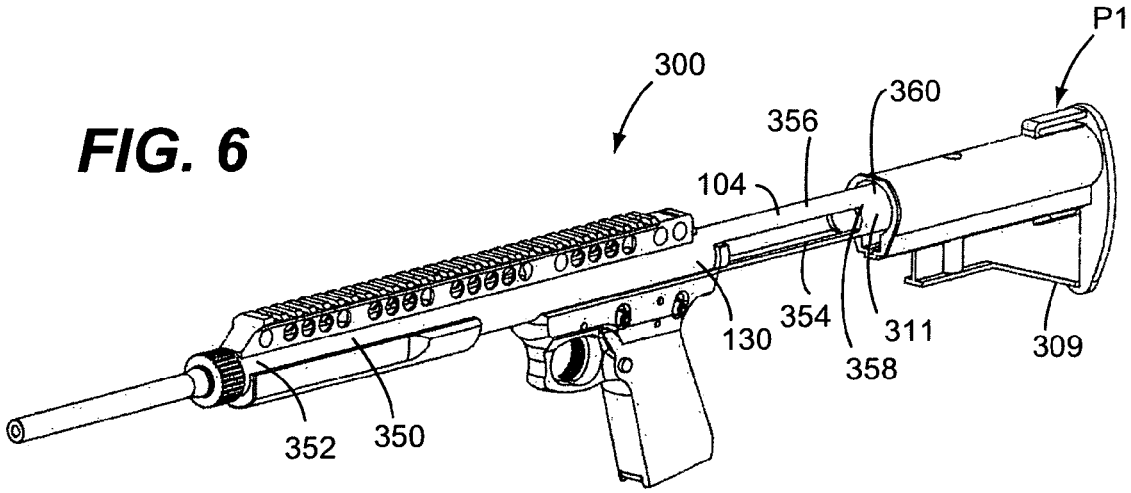
FIG. 6 is a perspective view of a firearm configured in accordance with an embodiment of the present invention, wherein such firearm has a fixed or telescoping-type shoulder stock structure mounted on a stock extension of a receiver structure.

As shown in FIG. 4, the rifle receiver structure 104 includes an ammunition delivery port 124 through which ammunition is delivered into the rifle receiver structure 104 from substantially as-manufactured trigger group housing 108 and includes a hammer port 126 through which a hammer of the substantially as-manufactured trigger group housing 108 can extend for allowing it to contact a firing pin in the substantially as-manufactured breech bolt 102. The rifle receiver structure 104 also includes an ejection port 128 through which spent casings are ejected. In the case where the substantially as-manufactured breech bolt 102 and the substantially as-manufactured trigger group housing 108 are that of a Ruger brand MK-series pistol, the ammunition delivery port 124, the hammer port 126, and the ejection port 128 can be configured in the same manner or similar manner to that disclosed in U.S. Pat. No. 2,585,275 of Ruger (e.g., as shown in FIGS. 1 and 6 thereof).

As shown in FIGS. 1-4, the rifle receiver structure 104 includes a tubular receiver body 130 and an accessory mounting rail 132 (e.g., an accessory rail configured in accordance with MIL-STD 1913) attached entirely to the tubular receiver body 130. As shown, the accessory mounting rail 132 integrally formed with the tubular receiver body 130 by means such as being integrally cast or extruded with the tubular receiver body 130. Optionally, the accessory mounting rail 132 can be a discretely formed article that is attached to the tubular receiver body 130 by means such as threaded fasteners.

The shoulder stock structure 109 is mounted entirely on and secured exclusively to the accessory mounting rail 132. The accessory mounting rail 132 includes a plurality of spaced apart apertures 134 in opposing side faces 136 thereof. Mounting lugs 138 of the shoulder stock structure 109 extend through respective ones of the spaced apart apertures 134. A shoulder stock body 140 of the shoulder stock structure 109 extends through each one of the mounting lugs 138. A stock release button 142 is disposed within one of the mounting lugs 138 for selectively releasing or securing the shoulder stock body 140 in a fixed or telescoping position within the mounting lugs 138, thereby permitting adjustment of stock length. In this manner, the substantially as-manufactured trigger group housing 108 is engaged with and secured to only the rifle receiver structure 104 such that the shoulder stock structure 109 and the substantially as-manufactured trigger group housing 108 are not directly engaged with or secured to each other.

Figure 5:
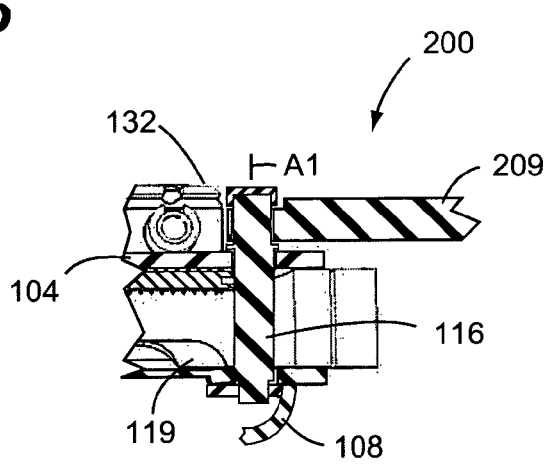
FIG. 5 is a cross-sectional view of a firearm configured in accordance with an embodiment of the present invention, wherein such firearm has a shoulder stock structure (e.g., folding type shoulder stock structure) integral with a breech bolt securing device.

Referring to FIG. 5, a rifle 200 (i.e., a firearm) configured in accordance with an embodiment of the present invention and having a shoulder stock structure 209 is shown. With exception to the shoulder stock structure 209, the overall construction of the rifle 200 can be substantively the same as that of the rifle 100 and, thus, similar elements of the rifle 200 and the rifle 100 will be described hereinafter using the same reference numerals.

In one embodiment, the shoulder stock structure 209 is of a folding type pivotably mounted on the breech bolt securing device 116 in a manner allowing the folding-type shoulder stock structure 209 to be pivoted about a pivot axis A1. The pivot axis A1 extends substantially parallel with a longitudinal axis of the breech bolt securing device 116. The substantially as-manufactured trigger group housing 108 is mounted on the rifle receiver structure 104 and is secured thereto by the breech bolt securing device 116. In this manner, the fixed or folding-type shoulder stock structure 209 is attached to the substantially as-manufactured trigger group housing 108 through the rifle receiver structure 104.

Referring to FIG. 6, a rifle 300 (i.e., a firearm) configured in accordance with an embodiment of the present invention and having a telescoping-type shoulder stock structure 309 is shown. With exception to the telescoping-type shoulder stock structure 309, a stock extension 311, and related structural elements and features, the overall construction of the rifle 300 can be substantively the same as that of the rifle 100 and, thus, similar elements of the rifle 300 and the rifle 100 will be described hereinafter using the same reference numerals.

The tubular receiver body 130 of the rifle receiver structure 104 includes a barrel receiving portion 350 that extends between a first end portion 352 of the tubular receiver body 130 and a bolt entry passage 354 extending through a sidewall 356 of the tubular receiver body 130. The shoulder stock extension 311 extends between a second end portion 360 of the tubular receiver body 130 and the bolt entry passage 354. The shoulder stock structure 309 is mounted entirely on and secured exclusively to the shoulder stock extension 311. The shoulder stock structure 309 is mounted entirely on and secured to the shoulder stock extension 311 in a manner allowing the shoulder stock structure 309 to be slid between a use position P1 and a stowed position (i.e., slid forward toward the bolt entry passage 354).

A rifle configured in accordance with the present invention (e.g., rifle 100, rifle 200, or rifle 300) can be made from components of a pistol by performing a plurality of operations of a method configured in accordance with an embodiment of the present invention. For example, with respect to the rifle 100, an operation can be performed for providing the substantially as-manufactured trigger group housing 108, which can be configured by an original equipment manufacturer (OEM) thereof for having a corresponding pistol receiver body thereof mounted thereon. The substantially as-manufactured trigger group housing 108 can also be configured for having an ammunition magazine mounted therein and for allowing ammunition to be supplied therethrough from the ammunition magazine to the pistol receiver body. An operation can be performed for providing the substantially as-manufactured breech bolt 102, which can be configured by the OEM for being mounted on the pistol receiver body. Thereafter, an operation can be performed for detachably mounting the rifle receiver structure 104 mounted on the substantially as-manufactured trigger group housing 108. The rifle receiver structure 104 can be configured for having the substantially as-manufactured breech bolt 102 mounted thereon, for having magazine-fed ammunition supplied thereto through the substantially as-manufactured trigger group housing 108, and for having the shoulder stock structure 109 mounted thereon. In one embodiment, detachably mounting the rifle receiver structure 104 on the substantially as-manufactured trigger group housing 108 can include engaging the substantially as-manufactured trigger group housing 108 with only the tubular receiver body 130 and securing the substantially as-manufactured trigger group housing 108 to only the tubular receiver body 130 such that the shoulder stock structure 109 and the substantially as-manufactured trigger group housing 108 are not directly engaged with or secured to each other. An operation can be performed for mounting the substantially as-manufactured breech bolt 102 on the rifle receiver structure 104. In one embodiment, mounting the substantially as-manufactured breech bolt 102 on the rifle receiver structure 104 can include slideably engaging the substantially as-manufactured breech bolt 102 within the central passage 110 of the tubular receiver body 130 (e.g., after inserting the substantially as-manufactured breech bolt 102 through the bolt entry passage 354 or inserting the substantially as-manufactured breech bolt 102 into the central passage 110 through an end face of the tubular receiver body 130). An operation can be performed for mounting the shoulder stock structure 109 entirely on the rifle receiver structure 104 (e.g., as is the case for the rifle 100 and the rifle 300) or for attaching the shoulder stock structure 109 to the substantially as-manufactured trigger group housing 108 through the rifle receiver structure 104 (e.g., as is the case for the rifle 200).

A rifle configured in accordance with the present invention (e.g., rifle 100, rifle 200, or rifle 300) can be made using a kit configured in accordance with an embodiment of the present invention. In one embodiment, such a kit can include the rifle receiver structure 104, the rifle barrel 106, and the shoulder stock structure 109. The rifle receiver structure includes the central passage 110, which is configured for having the substantially as-manufactured breech bolt 102 mounted therein, and includes one or more shoulder stock mounting portion configured for having the shoulder stock structure 109 engaged therewith. The rifle barrel 106 is mountable within the central passage 110 of the rifle receiver structure 104. The shoulder stock structure 109 includes a receiver structure engaging portion configured for allowing the shoulder stock structure 109 to be mounted on the rifle receiver structure 104 exclusively through engagement with the one or more shoulder stock mounting portions of the rifle receiver structure 104. Optionally, the shoulder stock engaging portions can be configured for allowing the shoulder stock structure 109 to be mounted on the substantially as-manufactured trigger group housing 108 through the rifle receiver structure 104 (e.g., as disclosed in reference to the rifle 200).

Thus, in view of the disclosures made herein, a skilled person will appreciate that the trigger group housing of a rifle configured in accordance with the present invention can be that of a Ruger .22LR automatic pistol, such as the trigger group housing of a Ruger brand Standard, Mk-I, Mk-II, Mk-III or 22/45 pistol. A skilled person will also appreciate that the invention disclosed herein relates to a rifle that provides the user with a lightweight and portable firearm and which shares many of the internal components with a pistol of similar trigger group, magazine and bolt design, and relates to a kit that provides for constructing a rifle by utilizing the trigger group housing with internal components, the breech bolt, and magazine of an automatic pistol of similar operation and internal design. A skilled person will also appreciate that an upper receiver structure configured in accordance with the present invention can be manufactured of lightweight aluminum alloy, permits the conversion of a pistol (e.g., a Ruger pistol) into a rifle or carbine while using many of the pistol's components, can be configured for allowing pistol-to-rifle conversion without any special tools or modification of pistol components, and can utilize the pistol's OEM-provided breech bolt, trigger group housing and magazines.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A kit for producing a rifle from components of a pistol, comprising:

a rifle receiver structure having a central passage configured for having a substantially as-manufactured breech bolt of a pistol slideably mounted directly therein and having at least one shoulder stock mounting portion configured for having a shoulder stock structure engaged therewith;

a rifle barrel mountable within the central passage of the rifle receiver structure, wherein a chamber end portion of the rifle barrel is configured for engaging a mating portion of the substantially as-manufactured breech bolt; and a shoulder stock structure including a receiver structure engaging portion configured for allowing the shoulder stock structure to be mounted on the rifle receiver structure exclusively through engagement with said at least one shoulder stock mounting portion of the rifle receiver structure.

2. The kit of claim 1 wherein:

the rifle receiver structure includes a tubular receiver body and an accessory mounting rail attached entirely to the tubular receiver body;

said at least one shoulder stock mounting portion includes the accessory mounting rail; and the shoulder stock structure and the accessory mounting rail are jointly configured for allowing the shoulder stock structure to be mounted entirely on and secured exclusively to the accessory mounting rail.

3. The kit of claim 1 wherein:

the rifle receiver structure includes a tubular receiver body;

a barrel receiving portion of the tubular receiver body extends between a first end portion of the tubular receiver body and a bolt entry passage extending through a sidewall of the tubular receiver body;

said at least one shoulder stock mounting portion includes a shoulder stock extension of the tubular receiver body extending between a second end portion of the tubular receiver body and the bolt entry passage; and the shoulder stock structure and the shoulder stock extension are jointly configured for allowing the shoulder stock structure to be mounted entirely on and secured exclusively to the shoulder stock extension.

4. The kit of claim 1 wherein:

the rifle receiver structure includes an accessory mounting rail; and said at least one shoulder stock mounting portion includes the accessory mounting rail.

5. The kit of claim 1 wherein:

the rifle receiver structure includes a shoulder stock extension; and said at least one shoulder stock mounting portion includes the shoulder stock extension.

6. The kit of claim 1 wherein the rifle receiver structure and the shoulder stock structure are jointly configured for allowing a substantially as-manufactured trigger group housing to be engaged with and secured to only the rifle receiver structure.

7. A kit for producing a rifle from components of a pistol, comprising:

a rifle receiver structure having a central passage configured for having a breech bolt of a pistol slideably mounted directly therein and having at least one shoulder stock mounting portion configured for having a shoulder stock structure engaged therewith, wherein the rifle receiver structure includes a tubular receiver body and wherein a barrel receiving portion of the tubular receiver body extends between a first end portion of the tubular receiver body and a bolt entry passage extending through a sidewall of the tubular receiver body;

a rifle barrel mountable within the central passage of the rifle receiver structure, wherein a chamber end portion of the rifle barrel is configured for engaging a mating portion of the breech bolt; and a shoulder stock structure including a receiver structure engaging portion configured for allowing the shoulder stock structure to be mounted on the rifle receiver structure exclusively through engagement with said at least one shoulder stock mounting portion of the rifle receiver structure.

8. The kit of claim 7 wherein said at least one shoulder stock mounting portion includes a shoulder stock extension of the tubular receiver body extending between a second end portion of the tubular receiver body and the bolt entry passage.

9. The kit of claim 7 wherein the shoulder stock structure and the shoulder stock extension are jointly configured for allowing the shoulder stock structure to be mounted entirely on and secured exclusively to the shoulder stock extension.

10. A kit for producing a rifle from components of a pistol, comprising:

a rifle receiver structure having a central passage configured for having a breech bolt of a pistol slideably mounted directly therein and having at least one shoulder stock mounting portion configured for having a shoulder stock structure engaged therewith, wherein the rifle receiver structure includes a tubular receiver body and an accessory mounting rail in combination with the tubular receiver body and wherein the shoulder stock structure and the accessory mounting rail are jointly configured for allowing the shoulder stock structure to be mounted entirely on and secured exclusively to the accessory mounting rail;

a rifle barrel mountable within the central passage of the rifle receiver structure, wherein a chamber end portion of the rifle barrel is configured for engaging a mating portion of the breech bolt; and a shoulder stock structure including a receiver structure engaging portion configured for allowing the shoulder stock structure to be mounted on the rifle receiver structure exclusively through engagement with said at least one shoulder stock mounting portion of the rifle receiver structure.

11. The kit of claim 7 wherein said at least one shoulder stock mounting portion includes the accessory mounting rail.

* * * * *